US007954483B2

(12) United States Patent
Kim et al.

(10) Patent No.: US 7,954,483 B2
(45) Date of Patent: Jun. 7, 2011

(54) CUTTING SEGMENT FOR CUTTING TOOL AND CUTTING TOOLS

(75) Inventors: Soo-Kwang Kim, Irvine, CA (US); Hee-Dong Park, Suwon (KR); Joon-Ho Chang, Ansan (KR); Jong-Ho Kim, Hwasung (KR)

(73) Assignees: Ehwa Diamond Industrial Co., Ltd., Osan, Kyungki-Do (KR); General Tool, Inc., Irvine, CA (US)

( * ) Notice: Subject to any disclaimer, the term of this patent is extended or adjusted under 35 U.S.C. 154(b) by 453 days.

(21) Appl. No.: 11/910,611

(22) PCT Filed: Apr. 19, 2006

(86) PCT No.: PCT/KR2006/001442

§ 371 (c)(1),
(2), (4) Date: Oct. 3, 2007

(87) PCT Pub. No.: WO2006/112654

PCT Pub. Date: Oct. 26, 2006

(65) Prior Publication Data

US 2008/0202488 A1 Aug. 28, 2008

(30) Foreign Application Priority Data

Apr. 21, 2005 (KR) ..... 10-2005-0033340
Mar. 8, 2006 (KR) ..... 10-2006-0021939

(51) Int. Cl.
*B28D 1/12* (2006.01)

(52) U.S. Cl. ..... 125/22

(58) Field of Classification Search ..... 451/548; 125/15, 22

See application file for complete search history.

(56) References Cited

U.S. PATENT DOCUMENTS

| | | | | |
|---|---|---|---|---|
| 2,811,960 | A | 11/1957 | Fessel | |
| 3,176,675 | A | 4/1965 | Bomba | |
| 4,883,500 | A | 11/1989 | Deakins et al. | |
| 5,049,165 | A | 9/1991 | Tselesin | |
| 5,092,082 | A | 3/1992 | Padberg et al. | |
| 5,433,187 | A | 7/1995 | Hayasaka et al. | |
| 5,620,489 | A | 4/1997 | Tselesin | |
| 5,725,421 | A | 3/1998 | Goers et al. | |
| 6,159,286 | A * | 12/2000 | Sung | 117/79 |
| 6,626,167 | B2 | 9/2003 | Kim et al. | |

(Continued)

FOREIGN PATENT DOCUMENTS

CH 597954 4/1978

(Continued)

*Primary Examiner* — Maurina Rachuba

(74) *Attorney, Agent, or Firm* — McDermott Will & Emery LLP

(57) ABSTRACT

The invention provides a cutting segment for a cutting tool for cutting or drilling a brittle work piece such as stone, bricks, concrete and asphalt, and a cutting tool having the cutting segment. The cutting segment includes a cutting surface for cutting a work piece and a plurality of abrasive particle layers. The abrasive particle layers are disposed perpendicular to a cutting direction. Each of the abrasive layers has a plurality of abrasive particle rows in a width direction of the cutting segment. Each of the abrasive rows has a plurality of abrasive particles arranged in a line. Further, the abrasive layers have a plurality of blank sections therebetween. In the blanks sections, abrasive particles are absent or have a concentration of 70% or less with respect to those in the abrasive rows. In addition, the blank sections include relatively thick blank sections and relatively thin blank sections.

22 Claims, 13 Drawing Sheets

U.S. PATENT DOCUMENTS

| | | | | |
|---|---|---|---|---|
| 7,124,753 | B2 | 10/2006 | Sung | |
| 7,134,430 | B2 | 11/2006 | Kim et al. | |
| 7,261,925 | B2 | 8/2007 | Nesbitt | |
| 7,337,775 | B2 | 3/2008 | Kim et al. | |
| 2002/0077054 | A1* | 6/2002 | Sung | 451/540 |
| 2002/0173234 | A1* | 11/2002 | Sung et al. | 451/21 |
| 2003/0084894 | A1* | 5/2003 | Sung | 451/533 |
| 2003/0089364 | A1 | 5/2003 | Kim et al. | |
| 2003/0109204 | A1* | 6/2003 | Sung | 451/56 |
| 2003/0114085 | A1* | 6/2003 | Choi et al. | 451/41 |
| 2004/0112359 | A1 | 6/2004 | Sung | |

FOREIGN PATENT DOCUMENTS

| | | |
|---|---|---|
| JP | 60-0092406 | 5/1985 |
| JP | 60-217064 | 10/1985 |
| JP | 03-161278 | 7/1991 |
| JP | 2003-103468 | 4/2003 |
| KR | 1999-011778 | 2/1999 |
| KR | 2003-0027434 | 4/2003 |
| KR | 2003-0067394 | 8/2003 |
| KR | 2004-0006361 | 1/2004 |
| WO | WO 03066275 | 8/2003 |
| WO | WO2005/014243 A2 | 2/2005 |

* cited by examiner

[Fig. 1]
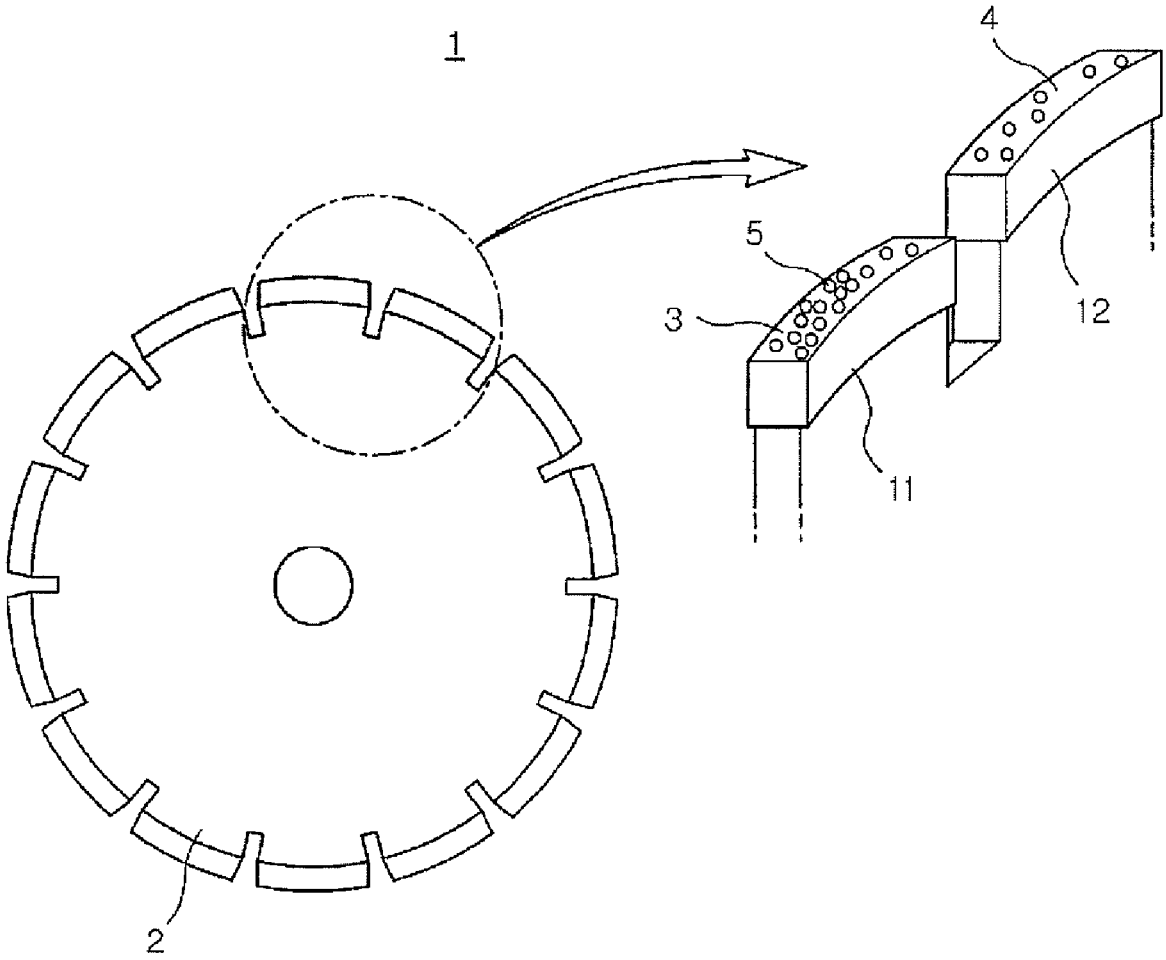

[Fig. 2]
(a)
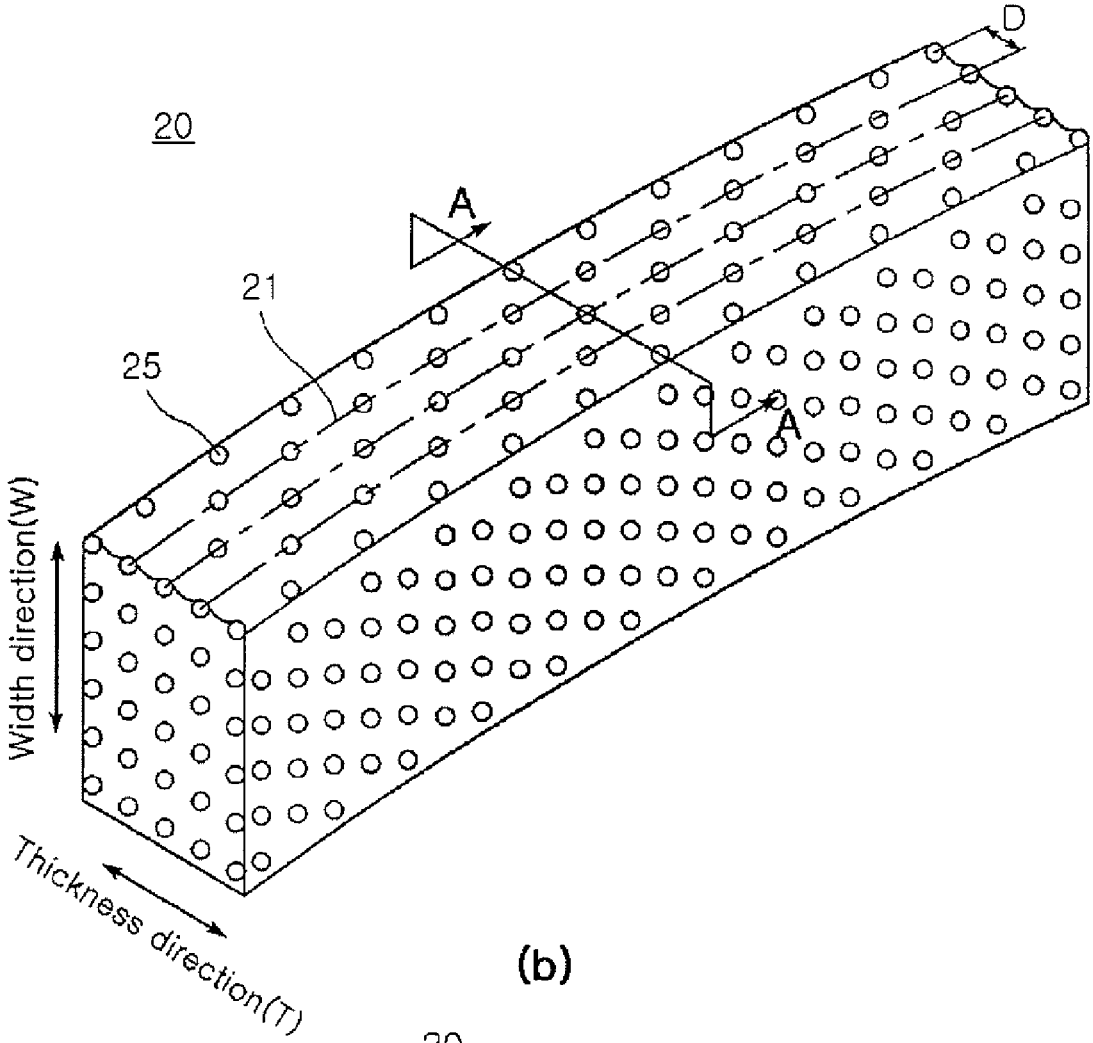
(b)
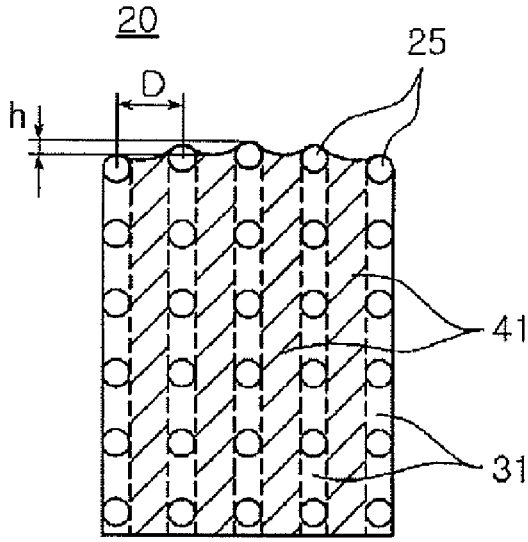

[Fig. 3]
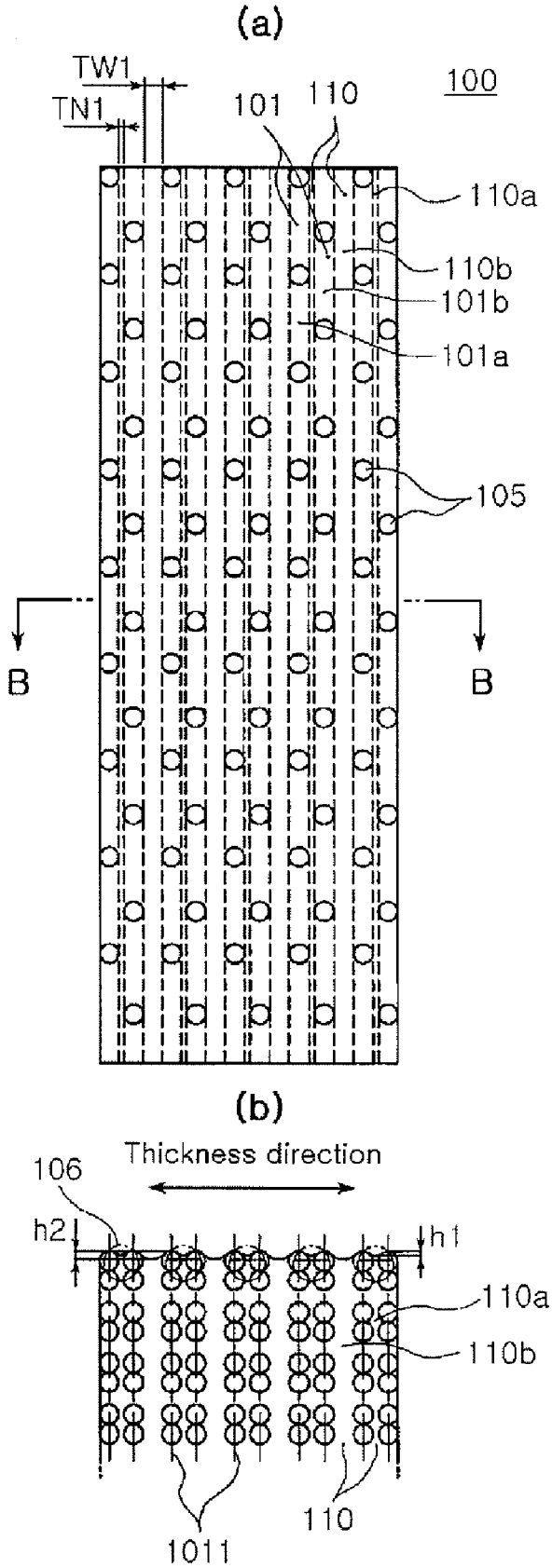

[Fig. 4]
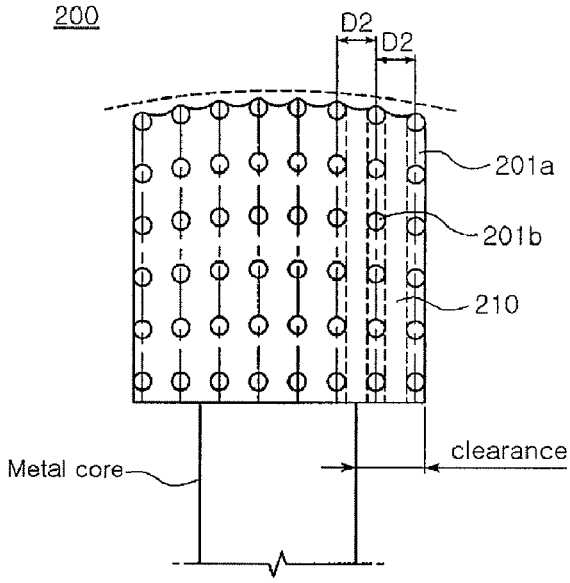
[Fig. 5]
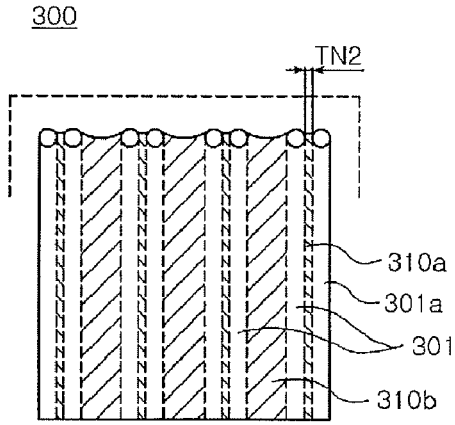
[Fig. 6]
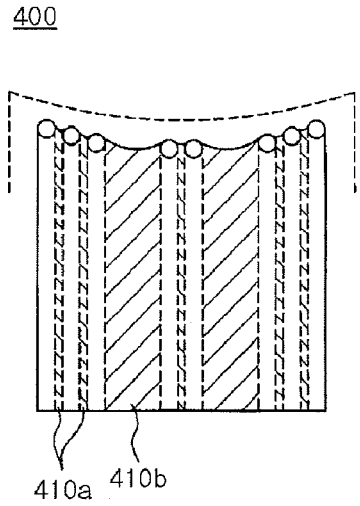

[Fig. 7]
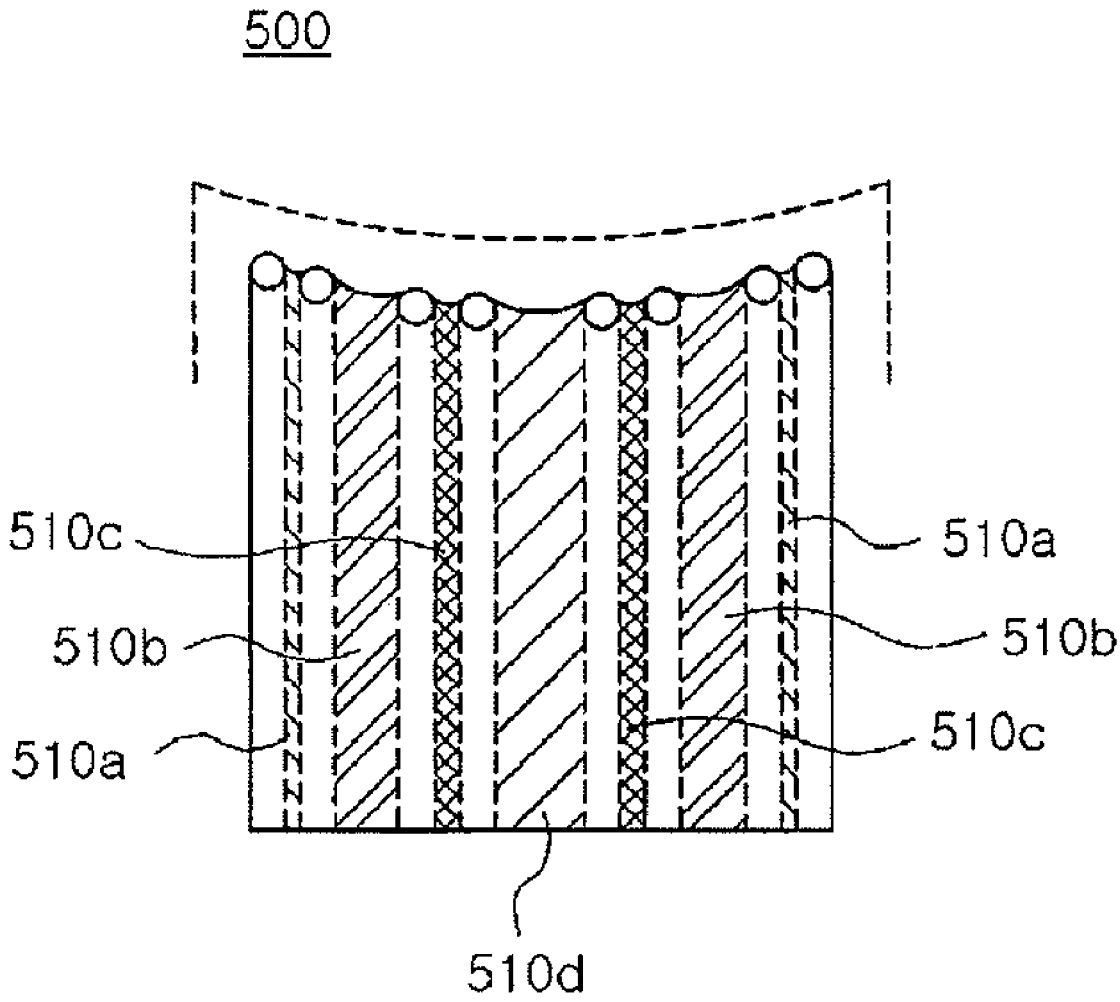

[Fig. 8]
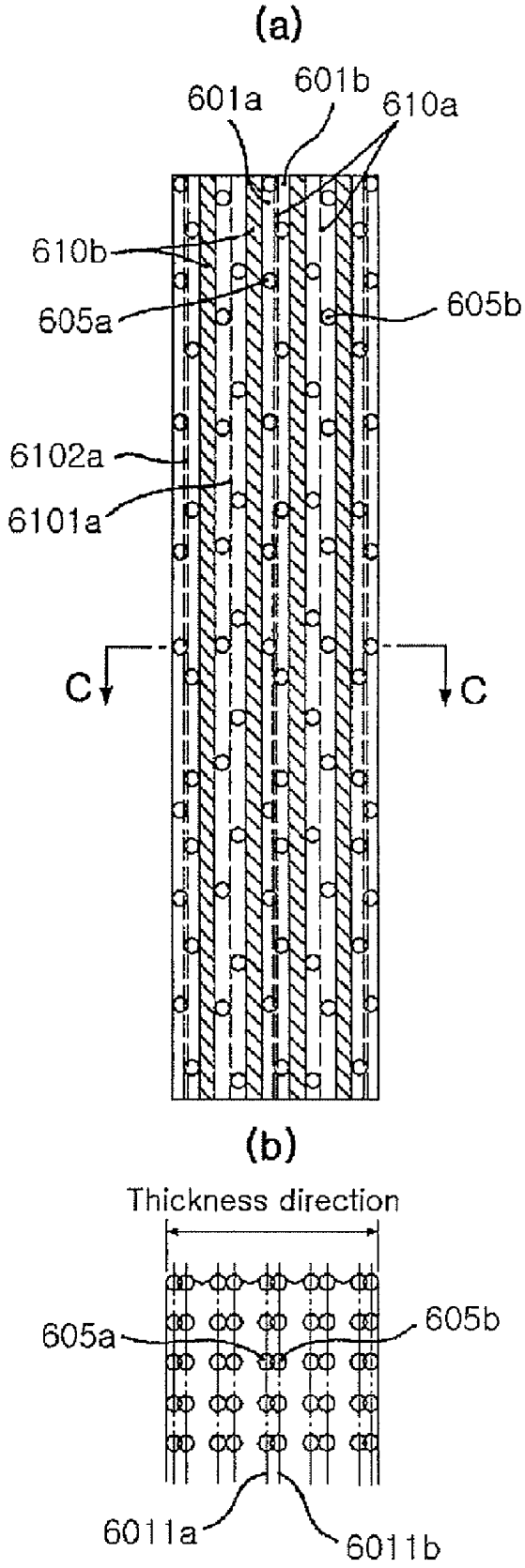

[Fig. 9]
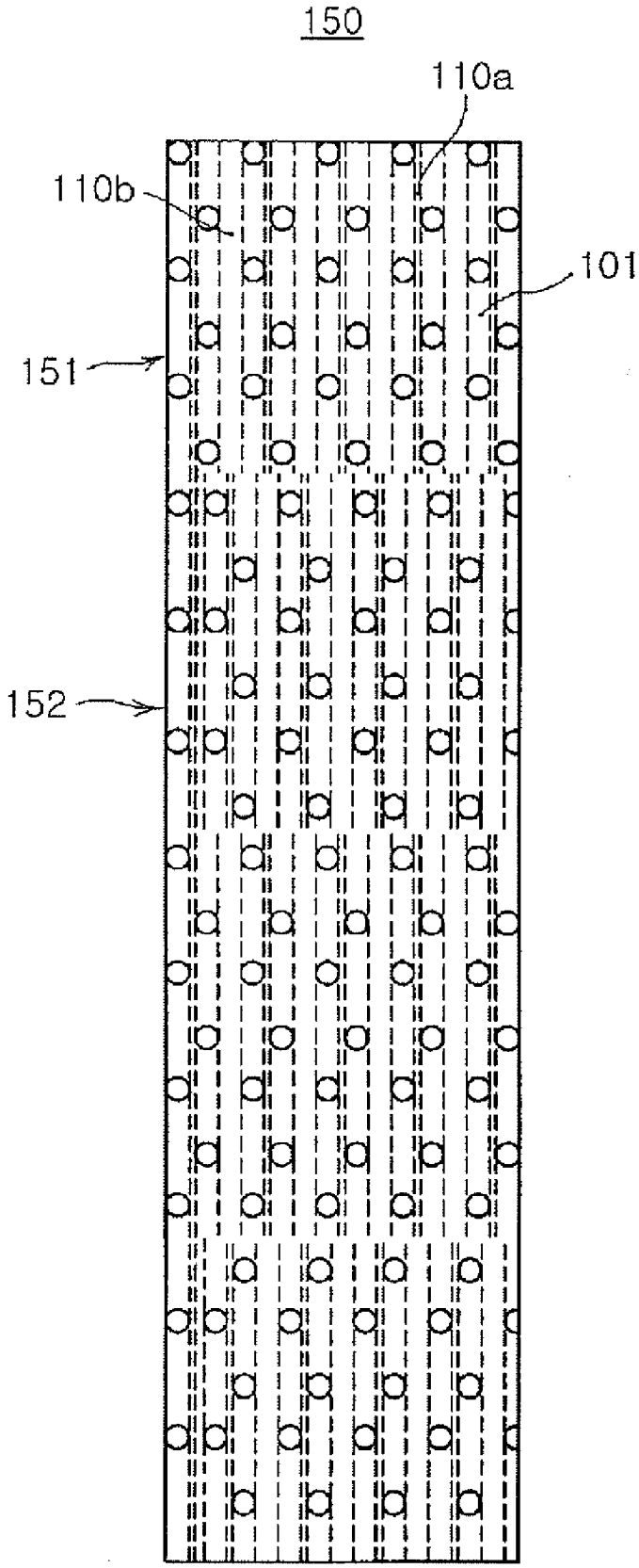

[Fig. 10]
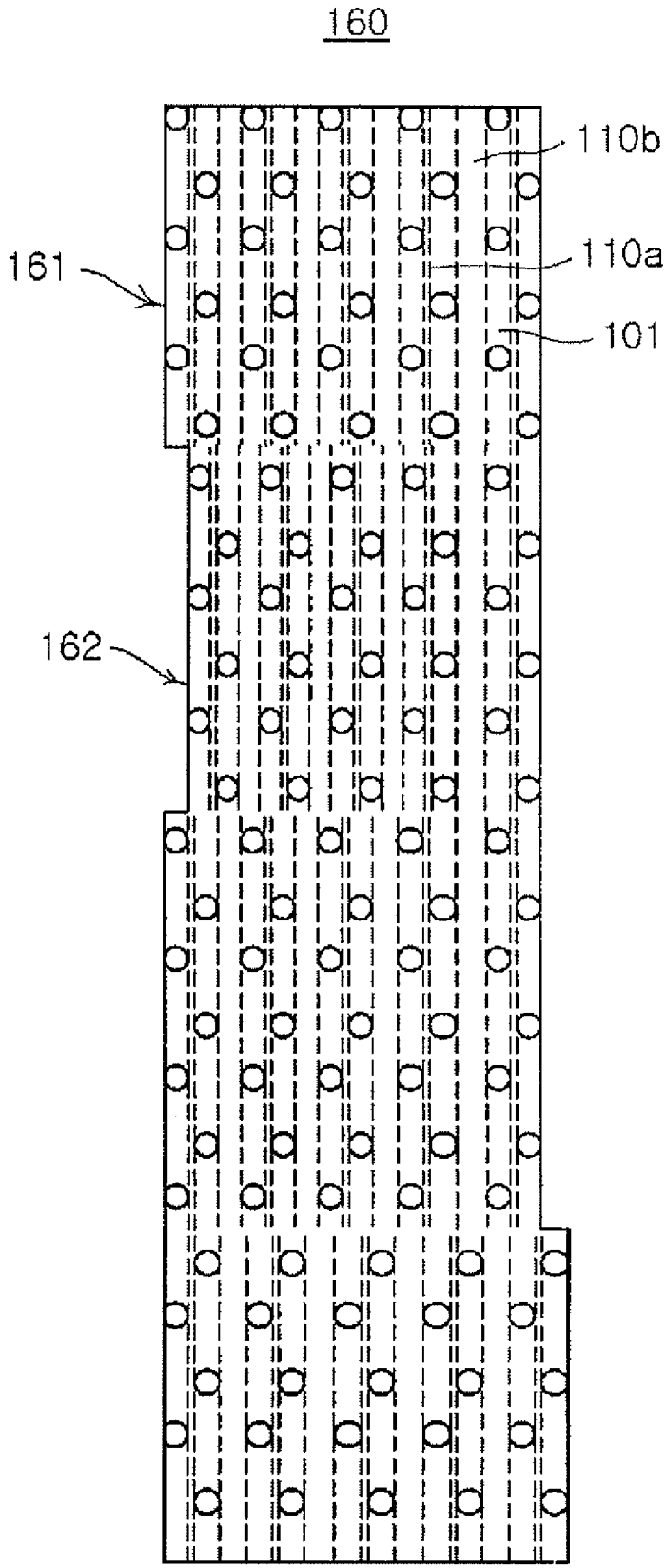

[Fig. 11]
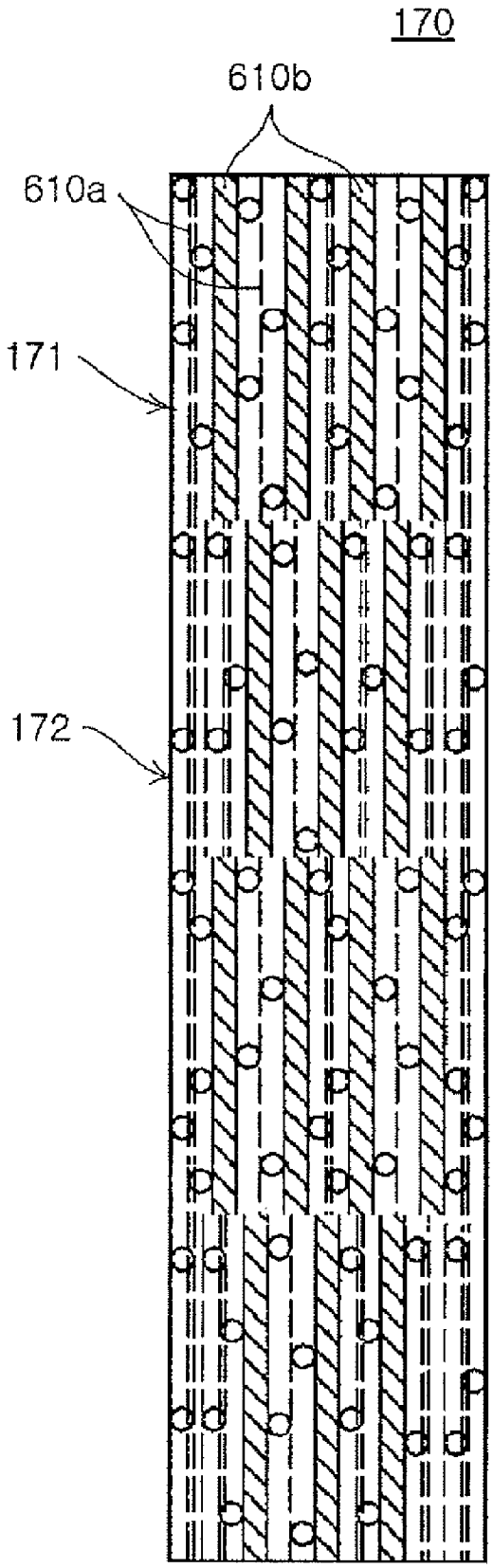

[Fig. 12]
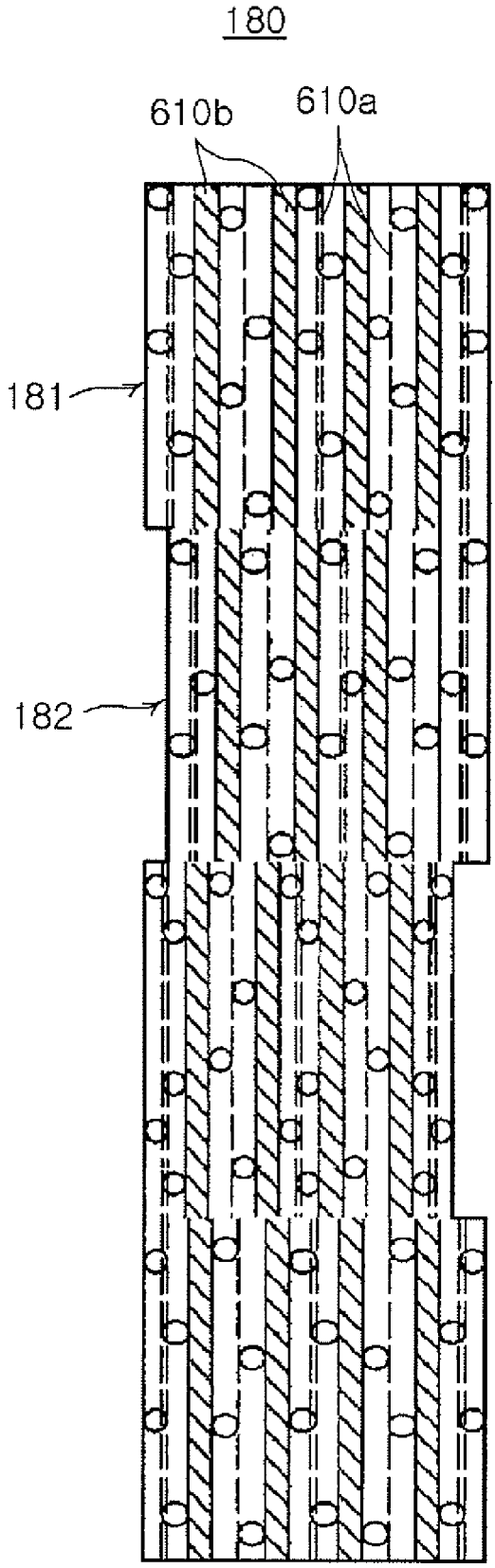

[Fig. 13]
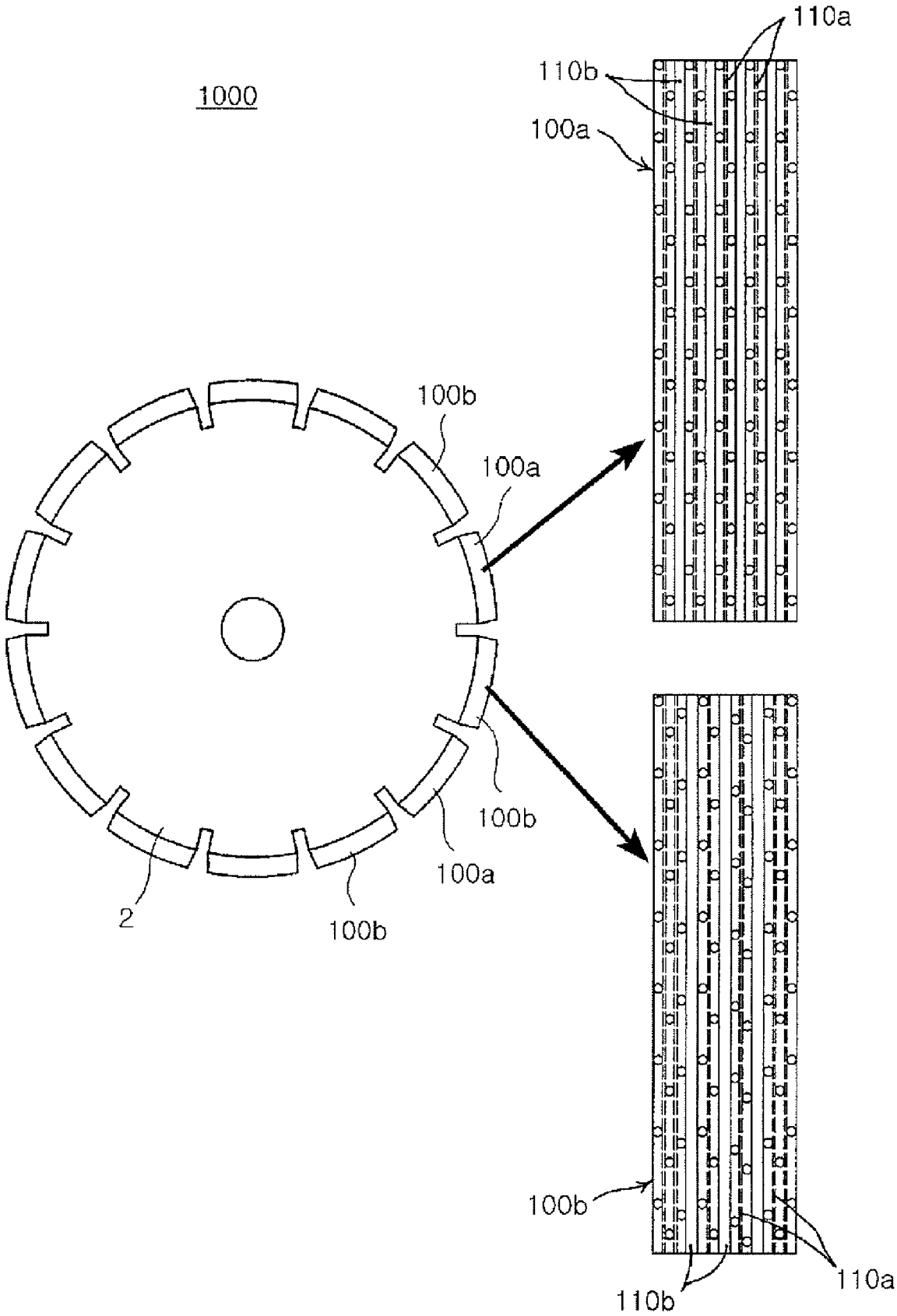

[Fig. 14]
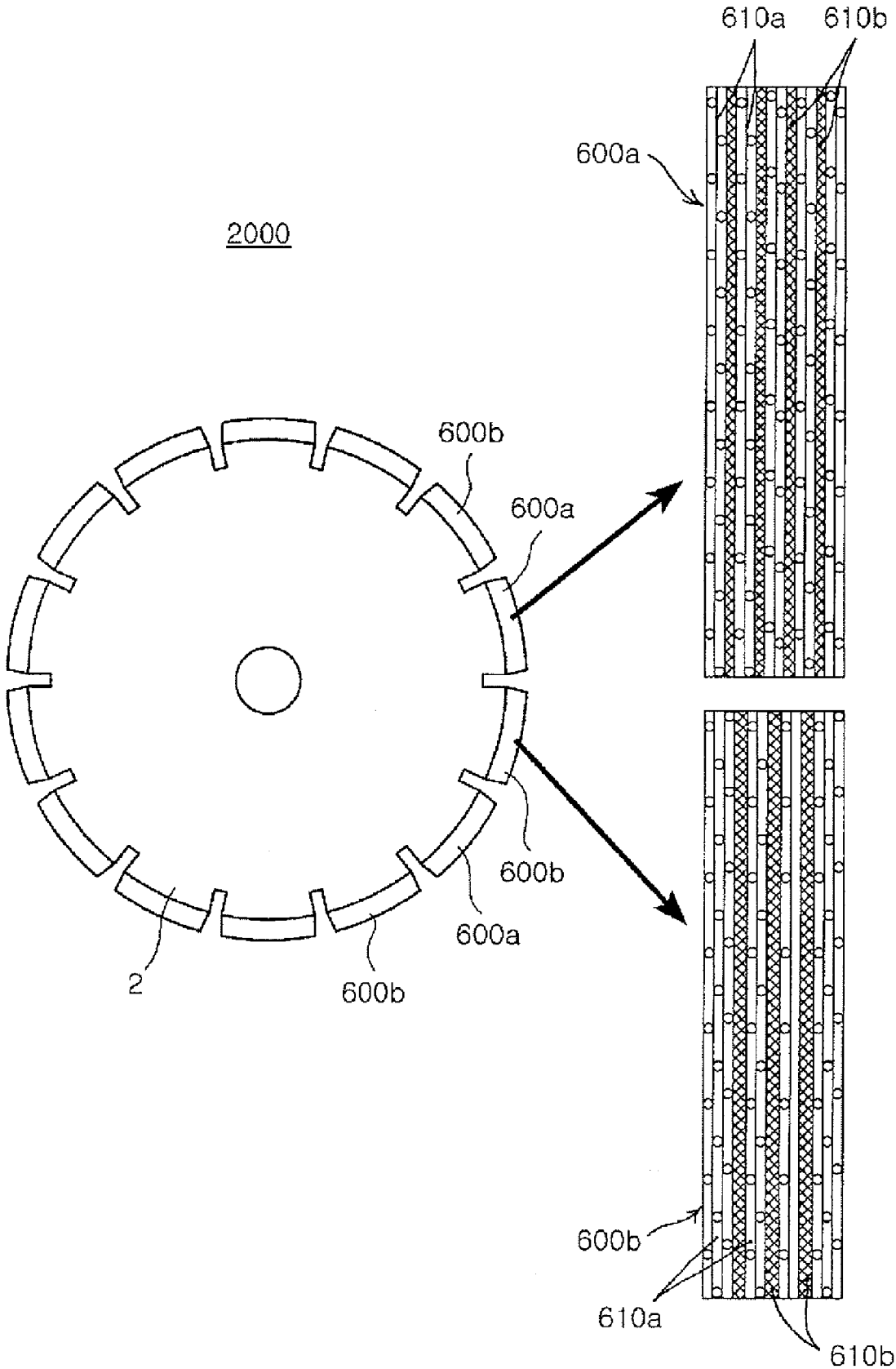

[Fig. 15]
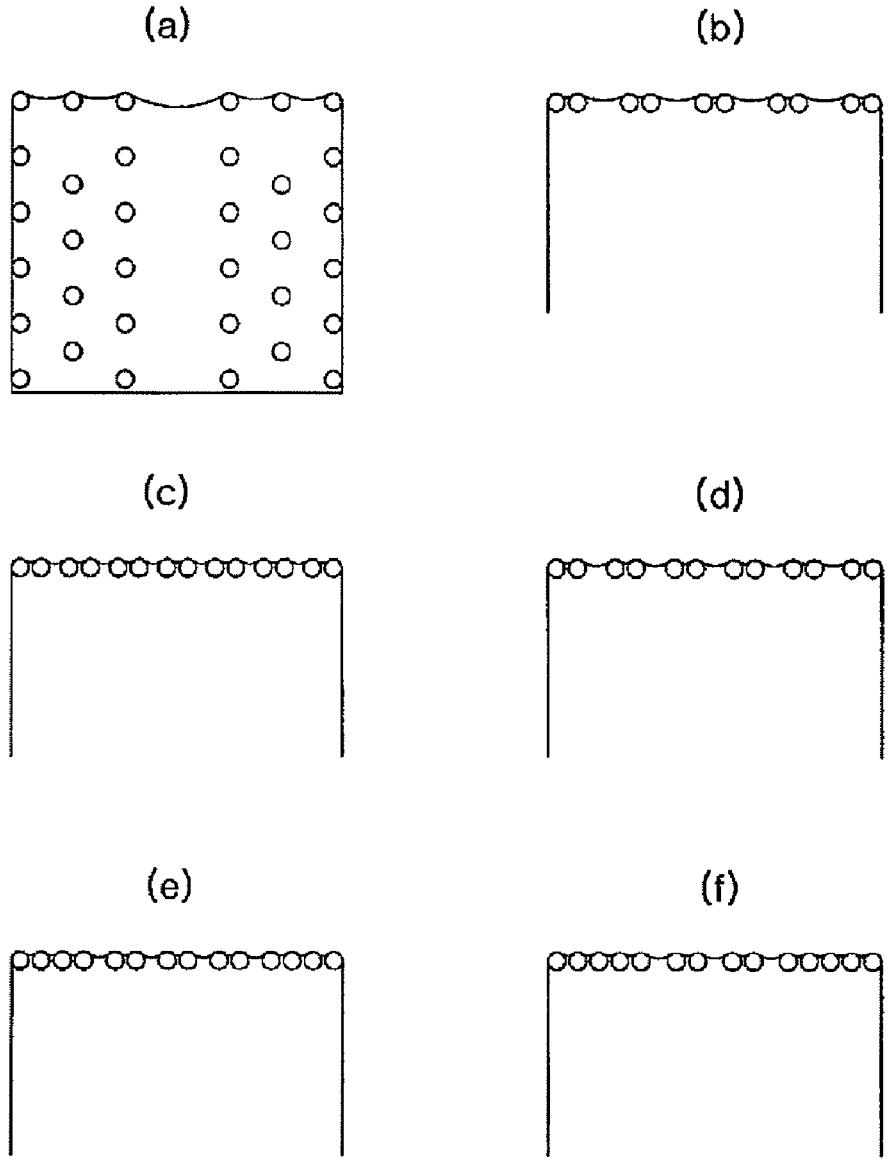
[Fig. 16]
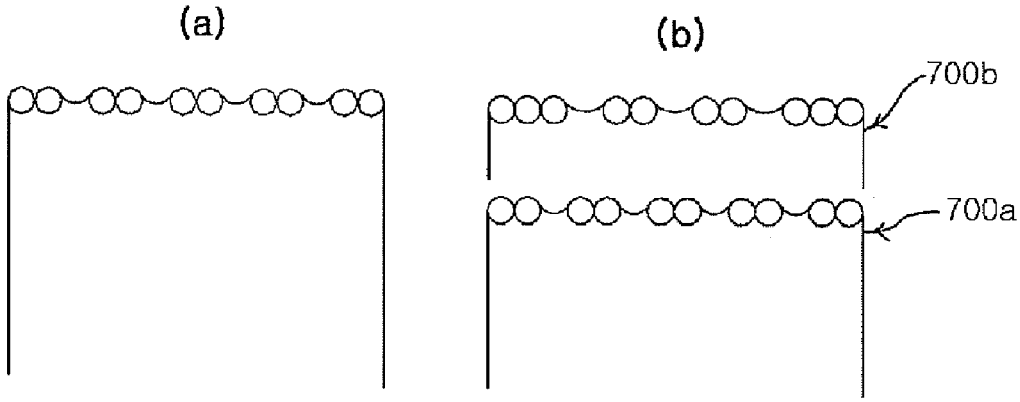

CUTTING SEGMENT FOR CUTTING TOOL AND CUTTING TOOLS

CROSS-REFERENCE TO RELATED APPLICATIONS

This application is a National Stage application of International Application No. PCT/KR2006/001442, with an international filing date of Apr. 19, 2006 based on Korean Patent Application No. 2005-33340 filed on Apr. 21, 2005 and Korean Patent Application No. 2006-21939 filed on Mar. 8, 2006.

TECHNICAL FIELD

The present invention relates to a cutting segment for a cutting tool for cutting or drilling a brittle work piece such as stone, bricks, concrete and asphalt, and a cutting tool having the cutting segment. More particularly, the present invention relates to a cutting segment improved in cutting rate and useful life by properly arranging abrasive particles, and a cutting tool having the cutting segment.

BACKGROUND ART

To cut or drill a brittle work piece such as stone, bricks, concrete and asphalt requires abrasive particles having higher hardness than a work piece.

The abrasive particles are exemplified by artificial diamond particles, natural diamond particles, nitrogen boride and super-hardness particles, of which artificial diamond particles are most widely used.

An artificial diamond (hereinafter referred to as "diamond" was invented in the 1950s. The diamond, which is known to have the highest hardness out of materials in the earth, has been accordingly used for cutting and grinding tools due to such properties.

Especially, the diamond has been broadly used in a stone processing field where stone such as granite and marble is cut and ground, and in a construction field where a concrete structure is cut and ground.

A cutting segment and a cutting tool, which will be explained hereunder, employ diamond particles as abrasive particles.

Typically, a diamond tool comprises segments having diamond particles dispersed therein and a metal core having the segments fixed thereto.

FIG. 1 illustrates an example of a segment type diamond tool.

As shown in FIG. 1, the segment type diamond tool 1 includes a plurality of segments 11 and 12 fixed to a disk-shaped metal core 2, in which each of the segments 11 and 12 has diamond particles 5 randomly dispersed therein.

The segments are fabricated via powder metallurgy in which the segments are mixed with metal powder, molded and then sintered.

In case of mixing the diamond particles with the metal powder as just described, the diamond particles are not evenly dispersed among the metal powder but randomly dispersed inside the cutting segment.

In the cutting tool having the cutting segment, its cutting rate is contradictory to its useful life.

For example, in case of using the metal powder with low abrasion resistance to enhance cutting rate, useful life of the cutting segment is shortened. In contrast, in case of using the metal powder with high abrasion resistance to extend useful life, the diamond particles blunted during cutting do not easily fall off, thus lowering cutting rate.

In addition, in case of mixing the diamond particles with the metal powder serving as a bond as just described, the diamond particles are not uniformly dispersed owing to differences between metal powders and diamond particles in terms of particle size and specific gravities. Therefore, as shown in FIG. 1, this disadvantageously leads to a cutting surface 3 having too many diamond particles or a cutting surface 4 having too few diamond particles, causing the diamond particles to segregate.

To overcome such problems, a cutting segment having diamond particles uniformly arranged has been suggested as shown in FIG. 2.

FIG. 2 (*b*) is a cross-sectional view of a cutting segment taken along the line A-A in FIG. 2(*a*), when used during a cutting process.

As shown in FIG. 2 (*a*), the cutting segment 20 has diamond particles 25 arranged in rows 21 in a cutting direction (in a length direction of the cutting segment). The diamond rows 21 are disposed in a width direction of the cutting segment to form a plurality of diamond particle layers 31 as shown in FIG. 2(*b*). The diamond layers are stacked in a thickness direction of the cutting segment.

As shown in FIG. 2 (*b*), the diamond particle layers 31 of the diamond particle rows 21 having the diamond particles 25 arranged are uniformly spaced apart from each other. In case of using the diamond particles smaller than a gap D between the diamond particle layers, the diamond layers 31 have an area without the diamond particles 41 therebetween.

In cutting a work piece via the cutting segment 20, blank sections are worn away first, thus generating grooves. The depth h of the grooves increases in proportion to the gap D between the diamond particle rows. If the depth h of the grooves of the blank sections is ⅔ of the average diameter of the abrasive particles, the diamond particles 25 easily fall off due to decline in retention by the metal powder.

Meanwhile, a small depth of the grooves improves useful life of the cutting segment but diminishes cutting rate owing to low protrusion of the abrasive particles.

In this fashion, the cutting segment 20 prevents the diamond particles 25 from segregating, thereby maximizing work efficiency for the diamond particles 25. Also, cutting rate can be boosted through a special concept of a "shoveling effect." However, due to the diamond particle rows equally spaced apart from each other, with increase in the depth h of the groove, the metal powder cannot sufficiently retain the diamond particles 25 so that the diamond particles are easily discharged during cutting.

In the end, the diamond particles 25 fall off not by abrasion but by a lacking retention power despite their cutting capability. This disadvantageously reduces useful life, especially for a work piece cut into large debris.

DISCLOSURE OF INVENTION

Technical Problem

The present invention has been made to solve the foregoing problems of the prior art and therefore an object according to certain embodiments of the present invention is to provide a cutting segment improved in cutting rate and useful life by adjusting the thickness of a blank section with no abrasive particles, and a cutting tool having the cutting segment.

Technical Solution

The present invention will be explained hereunder.

According to an aspect of the invention for realizing the object, there is provided a cutting segment for a cutting tool comprising a plurality of abrasive particle layers disposed perpendicular (thickness direction) to a cutting direction, each of the abrasive layers having a plurality of abrasive particle rows stacked in a width (vertical) direction of the cutting segment, each of the abrasive rows having a plurality of abrasive particles arranged in a line, wherein the abrasive particle layers have a plurality of blank sections therebetween, in which abrasive particles are absent or have a concentration of 70% or less with respect to those in the abrasive rows, and wherein the blank sections include relatively thick blank sections and relatively thin blank sections (thickness in a direction perpendicular to a cutting direction, i.e., a gap between abrasive particles).

According to another aspect of the invention for realizing the object, there is provided a cutting segment for a cutting tool comprising a plurality of abrasive particle layers disposed perpendicular (thickness direction) to a cutting direction, each of the abrasive particle layers having a plurality of abrasive particle rows stacked in a width (vertical) direction of the cutting segment, each of the abrasive particle rows having a plurality of abrasive particles arranged in a line, wherein the abrasive particle layers include therebetween a plurality of blank sections in which the abrasive particles are absent or have a concentration of 70% or less with respect to those in the abrasive particle rows, or a plurality of non-blank sections in which the abrasive particle layers contact or overlap each other.

According to further another aspect of the invention for realizing the object, there is provided a cutting segment for a cutting tool comprising at least two regions, each having a plurality of abrasive particle layers disposed perpendicular to a cutting direction in each of the regions, each of the abrasive particle layers having a plurality of abrasive particle rows stacked in a width direction of the cutting segment, each of the abrasive particle rows having a plurality of abrasive particles arranged in a line, wherein the abrasive particles are absent or have a concentration of 70% or less with respect to those in the abrasive rows, wherein the blank sections include relatively thick blank sections and relatively thin blank sections, and wherein at least some portions of the abrasive particle layers in leading and trailing ones of the regions are arranged so that a thin blank section of the trailing region passes along a thick blank section of the leading region during cutting of the work piece.

According to further another aspect of the invention for realizing the object, there is provided a cutting segment for a cutting tool comprising at least two regions, each of the regions having a plurality of abrasive particle layers disposed perpendicular to a cutting direction in each of the regions, each of the abrasive particle layers having a plurality of abrasive particle rows stacked in a width direction of the cutting segment, each of the abrasive particle rows having a plurality of abrasive particles arranged in a line, wherein the abrasive particle layers include therebetween a plurality of blank sections in which the abrasive particles are absent or have a concentration of 70% or less with respect to those in the abrasive particle rows and a plurality of non-blank sections in which the abrasive particle layers contact or overlap each other, and wherein at least some portions of the abrasive particle layers in leading and trailing ones of the regions are arranged so that a non-blank section of the trailing cutting region is disposed in a blank section of the leading cutting region during cutting of a work piece.

According to further another aspect of the invention for realizing the object, there is provided a cutting tool having the cutting segment of the invention as described above.

According to further another aspect of the invention for realizing the object, there is provided a cutting tool comprising: a plurality of cutting segments having abrasive particles dispersed therein; and a metal core having the cutting segments fixed thereto, wherein the cutting segments comprise a cutting segment of the invention as described above, and wherein at least some portions of abrasive particle layers in leading and trailing ones of the cutting segments are arranged so that a thin blank section of the trailing cutting segment passes along a thick blank section of the leading cutting segment during cutting of the work piece.

According to further another aspect of the invention for realizing the object, there is provided a cutting tool comprising: a plurality of cutting segments having abrasive particles dispersed therein; and a metal core having the cutting segments fixed thereto, wherein the cutting segments comprise a cutting segment of the invention as described above, and wherein at least some portions of abrasive particle layers in leading and trailing ones of the cutting segments, a non-blank section of the trailing cutting segment is disposed in a blank section of the leading cutting segment during cutting of a work piece.

The present invention will be explained in greater detail hereunder.

The present invention is directed to a cutting segment for a cutting tool for cutting or drilling a brittle work piece such as stone, bricks, concrete and asphalt, and a cutting tool having the cutting segment.

The cutting segment for the cutting tool includes abrasive particles for performing cutting on a work piece and a metal powder as a bond for fixing the abrasive particles.

The invention is directed to arrangement of the abrasive particles.

According to an exemplary cutting segment of the invention, the abrasive particles are arranged in rows in a cutting direction of the cutting segment and the abrasive rows are stacked vertically from (in a width direction of) the cutting segment to form a plurality of abrasive layers. The abrasive particle layers are disposed perpendicular (in a thickness direction of the cutting segment) to a cutting direction. Preferably, the number of the abrasive particle layers is four or more.

That is, each of the abrasive particle layers include a plurality of abrasive particle rows so that the abrasive particle rows appear on a cutting surface during cutting of a work piece.

The abrasive rows of the abrasive layers are evenly or unevenly concentrated in a length direction of the cutting segment.

That is, the abrasive rows are structured such that the abrasive particles may be equally spaced apart from each other (evenly concentrated) or at least some of the abrasive rows may be spaced apart from each other at different intervals (unevenly concentrated).

Also, at least two of the abrasive layers stacked in a thickness direction are equally concentrated.

That is, the abrasive particle layers may be concentrated evenly or unevenly. Preferably, the abrasive particle layers in a lateral portion of the cutting segment have a concentration greater than those in a central portion of the cutting segment.

Between the abrasive particle layers are blank sections in which the abrasive particles are absent or have a concentration of 70% or less with respect to those in the abrasive particle rows.

The blank sections include relatively thick (in a direction perpendicular to a cutting direction, i.e., a gap between abrasive particles) blank sections (hereinafter "thick blank sections") and relatively thin blank sections (hereinafter "thin blank sections").

According to the invention, preferably, the thin blank sections are disposed between the thick blank sections. More preferably, the number of the thin blank sections disposed between the thick blank sections is less than four.

The thick blank sections successively arranged weakens a power to retain the abrasive particles owing to more abrasion of metal powder, thereby causing the cutting segment to be rapidly worn away. Meanwhile, four or more of the thin blank sections successively arranged reduces protrusion height of the abrasive particles due to too shallow grooves in the thin blank sections, consequently deteriorating cutting rate.

Preferably, the thick blank sections each have a thickness of 0.75 to 2 times the average diameter of the abrasive particles. The thickness less than 0.75 times the average diameter of the abrasive particles excessively shallows grooves caused by abrasion, lowering protrusion height of the abrasive particle rows and thus diminishing cutting rate. In addition, the thickness more than 2 times excessively deepens the grooves resulting from abrasion, thereby potentially degrading useful life and stability of the cutting segment.

Preferably, the thin blank sections each have a thickness smaller than the thick blank sections each in a range that the abrasive particles arranged in two abrasive particle rows do not overlap, i.e., a range greater than 0.

Preferably, a thickness ratio of the thin blank sections to the thick blank sections is 1.5 times or more.

Preferably, the abrasive particle rows are stacked such that the abrasive particles are protruded successively on the cutting surface with uniform patterns during cutting of a work piece.

According to the invention, the blank sections each are not limited to the one having the thin blank sections and the thick blank sections with the same thickness, respectively. The thin blank sections may include two or more thin blank sections having a different thickness and also the thick blank sections may include two or more thick blank sections having a different thickness.

Preferably, a relatively thinnest one of thick blank sections has a thickness ratio of 1.5 times or more with respect to a relatively thickest one of the thin blank sections.

Further, a plurality of non-blank sections may be disposed between the abrasive particle layers of the cutting segment.

To form the non-blank sections, adjacent abrasive particle layers are arranged such that the abrasive rows of the adjacent abrasive particle layers contact or overlap each other.

That is, to form the non-blank sections, the abrasive particles of an abrasive particle layer and the abrasive particles of an adjacent one thereof contact or overlap each other in a cutting direction on a cutting surface.

In addition, by way of another example of the cutting segment of the invention, the segment includes at least two regions. At least some portions of the abrasive particle layers in leading and trailing ones of the regions are arranged so that a thin blank section of the trailing region passes along a thick blank section of the leading region during cutting of the work piece.

By way of further another example of the cutting segment of the invention, the segment includes at least two regions. At least some portion of the abrasive particle layers in leading and trailing ones of the regions are arranged so that a non-blank section of the trailing cutting segment is disposed in a blank section of the leading cutting segment during cutting of a work piece.

A cutting tool of the invention includes the cutting segment of the invention as just described.

According to a preferred embodiment of the cutting tool of the invention, the cutting tool employs a plurality of cutting segments. Also, at least some portions of the abrasive particle layers in leading and trailing ones of the cutting segments are arranged so that a thin blank section of the trailing cutting segment passes along a thick blank section of the leading cutting segment during cutting of the work piece.

According to another preferred embodiment of the cutting tool of the invention, the cutting tool employs a plurality of cutting segments. In addition, at least some portions of the abrasive particle layers in leading and trailing ones of the cutting segments are arranged so that a non-blank section of the trailing cutting segment passes along a blank section of the leading cutting segment during cutting of the work piece.

BRIEF DESCRIPTION OF THE DRAWINGS

The above and other objects, features and other advantages of the present invention will be more clearly understood from the following detailed description taken in conjunction with the accompanying drawings, in which:

FIG. 1 illustrates a conventional diamond tool having a cutting segment in which diamond particles are randomly dispersed;

FIG. 2 illustrates a conventional cutting segment having diamond particles evenly dispersed therein, in which (a) is a schematic view of the cutting segment and (b) is a cross-sectional view of the cutting segment taken along the line A-A;

FIG. 3 is a schematic view illustrating an exemplary cutting segment of the invention, in which (a) is a schematic view of a cutting surface and (b) is a cross-sectional view of the cutting segment taken along the line B-B during cutting;

FIG. 4 is a cross-sectional view of the cutting segment seen in front when a work piece is cut via a conventional cutting segment having blank sections uniformly spaced apart from each other;

FIG. 5 is a cross-sectional view of the cutting segment seen in front when a work piece is cut via a cutting segment of the invention;

FIG. 6 is a cross-sectional view of the cutting segment seen in front when a work piece is cut via another cutting segment of the invention;

FIG. 7 is a cross-sectional view of the cutting segment seen in front when a work piece is cut via further another cutting segment of the invention;

FIG. 8 is a schematic view illustrating another exemplary cutting segment of the invention, in which (a) is a schematic view of the cutting segment and (b) is a cross-sectional view of the cutting segment taken along the line C-C during cutting;

FIG. 9 is a schematic view illustrating further another exemplary cutting segment of the invention;

FIG. 10 is a schematic view illustrating further another exemplary cutting segment of the invention;

FIG. 11 is a schematic view illustrating further another exemplary cutting segment of the invention;

FIG. 12 is a schematic view illustrating further another exemplary cutting segment of the invention;

FIG. 13 is a schematic view illustrating a preferred embodiment of a cutting tool of the invention;

FIG. 14 is a schematic view illustrating another preferred embodiment of a cutting tool of the invention;

FIG. 15 is a cross-sectional view illustrating the cutting segments seen in front during cutting according to the invention; and FIG. 16 is a cross-sectional view illustrating the cutting segments of a cutting tool seen in front according to the invention.

BEST MODE FOR CARRYING OUT THE INVENTION

Preferred embodiments of the present invention will now be described in detail with reference to the accompanying drawings.

FIG. 3 illustrates an exemplary cutting segment of the invention.

FIG. 3 (*b*) is a cross-sectional view of the cutting segment taken along the line B-B in FIG. 3 (*a*) during cutting.

As shown in FIG. 3 (*a*), the cutting segment 100 of the invention includes a plurality of abrasive particle rows 101 having abrasive particles 105 arranged in a cutting direction of the cutting segment 100. The abrasive particle rows 101 are stacked in a width direction of the cutting segment 100 to form a plurality of abrasive particle layers 1011 as shown in FIG. 3(*b*). The abrasive particle layers 1011 are disposed perpendicular to a cutting direction (in a thickness direction of the cutting segment).

The abrasive layers 1011A have a plurality of blank sections 110 therebetween. In the blank sections 110, thin blank sections 110*a* and thick blank sections 110*b* alternate each other.

In cutting a work piece via the cutting segment 100, as shown in FIG. 3 (*b*), the thin blank sections 110*a* are relatively less worn away so that the depth h1 of grooves is shallower, thus enhancing a retention power of adjacent abrasive particles. The thick blank sections 110*b* are relatively more worn away so that the depth h2 of the grooves is deeper.

In this fashion, abrasive particles 105 adjacent to the thin blank sections 110*a* are sufficiently retained at least on a side so that the abrasive particles 105 do not fall off easily, thereby lengthening useful life of the cutting segment. At the same time, the grooves have a great depth h2 due to the thick blank sections so that the abrasive particles are protruded sufficiently, thereby improving cutting rate of the cutting segment.

A major mechanism for increase in cutting rate and useful life will be explained hereunder according to the invention.

As shown in FIG. 3 (*b*), virtual big abrasive particles 106 are arranged on the abrasive particle rows 101 including the thin blank sections 110*a*. The depth h2 of the grooves caused by the worn-away thick blank sections demonstrates protrusion height between the virtual abrasive particles. Given this, the virtual big abrasive particles 106 enhance cutting rate, and prolongs useful life due to the smaller depth h2 of the grooves than the size of the virtual big abrasive particles 106.

Preferably, the thick blank sections 110*b* each have a thickness TW1 of 0.75 to 2 times the average diameter of the abrasive particles. Also, the thin blank sections 110*a* each have a thickness TN1 smaller than that of the thick blank sections 110*b* each within a range greater than 0, i.e., the range in which two abrasive particle rows 101*a* and 101*b* between the thin blank sections 110*a* do not overlap each other.

Preferably, a thickness ratio TW1/TN1 of the thin blank sections 110*a* to the thick blank sections 110*b* is 1.5 times or more.

FIGS. 4 to 7 are cross-sectional views illustrating cutting segments with a total thickness of T and eight rows of abrasive particles arranged therein. FIG. 4 illustrates an example of a conventional cutting segment having blank sections uniformly spaced apart from each other. FIG. 5 is an exemplary cutting segment having a plurality of thin blank sections and a plurality of thick blank sections alternate with each other according to the invention. Also, FIG. 6 is another exemplary cutting segment having two blank sections on an outermost side, and then a thick blank section, a thin blank, a thick blank section and two thin blank sections disposed side by side in their order. FIG. 7 is further another exemplary cutting segment 500 having first thin blank sections 510*a* on both outermost sides, and then first thick blank sections 510*b*, second thick blank sections 510*c* and a second thick blank section 510*d* disposed side by side in their order.

Thus, the second thick blank section 510*d* is disposed in the most central portion of the cutting segment. At this time, the second thin blank sections 510*c* are thicker than the first thin blank sections 510*a* on the outermost sides and thinner than the first thick blank sections 510*b*. Also, the second thick blank section 510*d* is thicker than the first thick blank sections 510*b*.

As shown in FIG. 4, the conventional cutting segment 200 having the blank sections uniformly spaced apart D2 from each other is worn away so that its upper surface is rounded, which will be explained hereunder.

An abrasive particle row 201*a* in the outermost layer of the cutting segment easily falls off since one side thereof is not retained by metal powder and the blank section 210 on the opposite side is grooved and thus insufficiently retained.

Therefore, an adjacent abrasive particle row 201*b* is worn away in a relatively great portion, thus forming a round surface R with respect to a center of the cutting segment.

In case of rounding that occurs as just described, a cutting surface of the cutting segment is prone to warping since the cutting tool cannot cut a work piece straightly. This also causes the cutting segment to sustain greater load due to a larger cutting area. The abrasion in a lateral portion, if accelerated, removes clearance between a metal core and the cutting segment, thus rendering the cutting tool useless despite availability of the cutting segment.

As shown in FIG. 5, in a cutting segment 300 having a plurality of thin blank sections 310*a* and a plurality of thick blank sections 310*b* alternate with each other, as in the conventional cutting segment 200, an outermost one 301*a* of abrasive particle rows 301 is not sufficiently retained by metal powder on a side. However, at least one side of the outermost abrasive particle row 301 is sufficiently retained since the thin blank sections 310*a* on the opposite sides, which have a small thickness TN2, are worn away into shallow grooves.

Therefore, in a thickness direction of the cutting segment 300, the cutting segment 300 is worn away in a rectangular shape with angled edges.

As shown in FIG. 6, a cutting segment 400 is disposed with two thin blank sections 410*a* on an outermost side, and then a thick blank section 410*b*, a thin blank section 410*a*, a thick blank section 410*b* and two thin blank sections 410*a* side by side in their order. In this case, the thin blank sections on an outermost side are less abraded than the thick blank section in the central portion. This causes the cutting segment 300 to be abraded in a concave shape.

Referring to FIG. 7, a cutting segment 500 is disposed with first thin blank sections 510*a* in outermost portions, and then first thick blank sections 510*b*, second thin blank sections 510*c* and a second thick blank section 510*d* side by side in their order. Thus, the second thick blank section 510*d* is disposed in a central portion. At this time, the second thin blank section 510*c* is thicker than the first blank sections 510*a* and thinner than the first thick blank sections 510*b*. The second thick blank section 510*d* is much thicker than the first thick blank sections 510*b*. In this cutting segment 500, the thickness of the blank sections increases toward a central portion, thereby causing the cutting segment 500 to be abraded in a concave shape.

In case where a cutting segment is abraded in a rectangular or concave shape as in the cutting segments 300 and 400 of the invention, a work piece is cut straightly, thereby allowing the cutting segment to sustain less cutting load and to be rendered useful till its complete abrasion.

FIG. 8 illustrates an exemplary cutting segment 600 of the invention including a non-blank section 610*a*.

As shown in FIG. 8 (*a*), the cutting segment 600 has a plurality of non-blank sections 610*a* and a plurality of blank sections 610*b* alternate with each other in a direction perpendicular to a cutting direction of the cutting segment. The non-blank sections 610*a* are disposed between adjacent abrasive particle layers and have no abrasive particles arranged therein.

In the non-blank sections 610*a*, abrasive particles contact (as in numeral sign 6101*a*) or overlap (as in numeral sign 6102*a*) each other when seen from a cutting surface of the cutting segment.

In the non-blank sections 610*a*, as shown in FIGS. 8 (*a*) and 8 (*b*), abrasive particle layers 6011*a* and abrasive particle layers 6011*b*, which are adjacent each other, are arranged such that an abrasive particle row 601*a* of an abrasive particle layer 6011*a* and an abrasive particle row 601*b* of an adjacent abrasive particle layer 6011*b* contact or overlap each other on a cutting surface.

That is, the non-blank sections 610*a* are formed so that abrasive particles 605*a* of the abrasive particle layer 6011*a* and abrasive particles 605*b* of the adjacent abrasive layer 6011*b* contact or overlap in a cutting direction on the cutting surface.

The blank sections 610*b* may have uniform or various thickness.

FIGS. 9 to 12 illustrate other exemplary cutting segments of the invention.

As shown in FIGS. 9 to 12, the cutting segments 150, 160, 170 and 180 each include at least two regions of 151,152; 161,162; 171,172 and 181,182. Each of the regions includes a plurality of abrasive particle layers in a direction perpendicular to a cutting direction.

As shown in FIGS. 9 to 10, thin blank sections 110*a* and thick blank sections 110*b* are disposed between the abrasive particle layers (abrasive particle rows 101).

In FIGS. 9 and 10, at least some portions of the abrasive particle layers in the leading and trailing regions 151, 152 and 161, 162 are arranged so that a thin blank section of the trailing cutting segment passes along a thick blank section of the leading cutting segment during cutting of the work piece.

Also, as shown in FIGS. 11 to 12, the abrasive particle layers include therebetween a plurality of blank sections 610*b* in which the abrasive particles are absent or have a concentration of 70% or less with respect to those in the abrasive particle rows and a plurality of non-blank sections 610*a* in which the abrasive particle layers contact or overlap each other.

In FIG. 11, at least some portions of the abrasive particle layers in the leading and trailing regions 171 and 172 are arranged so that a non-blank section of the trailing cutting segment is disposed in a blank section of the leading cutting segment during cutting of a work piece.

The abrasive particle layers are arranged between the adjacent ones of the regions so that the abrasive particle layers and blank sections in the regions are shifted in a thickness direction of the cutting segment as in FIGS. 9 to 11 or the regions are shifted in a thickness direction of the cutting segment with respect to adjacent regions as in FIGS. 10 to 12.

FIG. 13 illustrates a preferred embodiment of a cutting tool of the invention.

As shown in FIG. 13, a cutting tool 1000 has a metal core 2 fixed with a plurality of cutting segments.

Adjacent ones 100*a* and 100*b* of the cutting segments are arranged such that a thin blank section 110*a* of a trailing cutting segment 100*b* is disposed in a thick blank section 110*b* of a leading cutting segment 100*a* during cutting of a work piece.

In cutting the work piece via the cutting tool, the thin blank section 110*a* of the trailing cutting segment 100*b* passes along the thick blank section 110*b* of the leading cutting segment 100*a*. That is because the leading cutting segment 100*a* and trailing cutting segment 100*b* are bonded to the metal core 2 alternately.

Therefore, in an overall sense, this prevents serious abrasion in the thick blank section 110*b*, thereby extending useful life of the cutting segment.

Also, the thin blank section 110*a* is abraded into a shallow groove, thus increasing retention of the abrasive particles and lengthening useful life of the cutting tool.

Furthermore, the trailing cutting segment 100*b* is capable of cutting a portion which the leading cutting segment 100*a* fails to cut during cutting of the work piece, thereby enhancing cutting rate of the cutting tool.

FIG. 14 illustrates another exemplary cutting tool of the invention.

As shown in FIG. 14, a cutting tool 2000 has a metal core 2 fixed with a plurality of cutting segments of the invention.

Adjacent ones of the cutting segments 600*a* and 600*b* are arranged such that a non-blank section 610*a* of a trailing cutting segment 600*b* is disposed in a position corresponding to a blank section 610*b* of a leading cutting segment 600*a*.

Also when a work piece is cut via the cutting tool 2000, in an overall sense, the blank section 610*b* is prevented from being severely abraded, thus prolonging useful life of the cutting tool as in the cutting tool 10000 as just described.

The non-blank section 610*a* is abraded into a shallow groove so that retention of abrasive particles is increased to extend useful life of the cutting tool.

Also, the trailing cutting segment 600*b* is capable of cutting a portion which the leading cutting segment 600*a* fails to cut during cutting of a work piece, thereby improving cutting rate of the cutting tool.

MODE FOR THE INVENTION

Preferred embodiments of the present invention will now be described in detail with reference to the accompanying drawings.

Example 1

One saw blade was manufactured according to the invention (Inventive product 1) and two saw blades were manufactured according to the prior art (Conventional products 1 and 2). The inventive and conventional saw blades were used to examine cutting rate and useful life of cutting segments in order to cut a granite work piece. The results are shown in Table 1.

Also, abrasion shapes of the cutting segments were observed.

Herein, Inventive product 1 used diamond particles as abrasive particles. The segments each had a length L of 40 mm, thickness T of 3.2 mm, width W of 10.0 mm, diameter R of 168 mm, and average diamond concentration of 0.8Conc. The diamond particles used were MBS-955 available from D.I corp. of U.S.A., with a particle size of US 40/50 mesh and an average diameter of 400□.

FIG. 15 (*a*) illustrates shapes of cutting segments in Inventive product 1 according to this embodiment.

In Inventive product 1, diamond particles were arranged in six rows parallel to a cutting direction, two thin blank sections were disposed successively at an interval of 0.1 mm in a lateral portion of the cutting segment. The thickness of a thick blank section in a central portion had a ratio of 1.0 with respect to the average diamond particle size. The thick blank section had a thickness of 0.4 mm. Also, the thickness ratio between the thin blank section and the thick blank section was 4.

Conventional product 1 had dimensions equal to those of Inventive product 1, i.e., a length L of 40 mm, thickness T of 3.2 nm, width W of 10.0 mm, diameter R of 168 mm and average concentration of 0.8 Conc., with diamond particles randomly dispersed across the cutting segment.

Conventional product 1 had the diamond particle type and size equal to those of Inventive product 1.

Conventional product 2 was shaped identical to Conventional 1, also with the same average concentration and particle size. The diamond particles were arranged in 6 rows at an equal interval. Accordingly, all blank sections each had a width of 0.16 mm.

The machine used was a bridge sawing machine available from PEDRINI corp. The cutting tool was sized 14 inches, with a rotational speed of 1800 rpm and a cutting speed of 3M per minute.

A work piece was cut with a depth of 30 mm, and a length of 288 m.

Inventive product 1, Conventional product 1 and Conventional product 2 used, as a metal powder (bond), a mixture of cobalt, steel and copper having an equal composition.

Cutting index shown in Table 1 indicates the amount of power kWh necessary for cutting a work piece sized 1□. The smaller value thereof means a higher cutting rate. Useful life indicates the area □ of the work piece cut when the cutting segment has abrasion of 1 mm. The bigger value thereof means a longer useful life.

TABLE 1

| Sample No. | Inventive 1 | Conventional 1 | Conventional 2 |
|---|---|---|---|
| Cutting index [kWh/□] | 1.115 (100%) | (76.1%) | (85.2%) |
| Useful life [□/mm] | 4.341 (100%) | (86.3%) | (78.3%) |

As seen in Table 1, Inventive product 1 exhibits superior useful life and cutting rate to Conventional products 1 and 2. Inventive product 1 had diamond particles arranged in rows, which were divided into thin blank sections and thick blank sections. Conventional product 1 had diamond particles randomly dispersed therein. Conventional product 2 had diamond particles arranged in rows, however at an uniform interval in a thickness direction of the cutting segment.

Moreover, in Inventive product 1, the cutting segment was abraded in a rectangular shape with a side end portion left intact. On the contrary, Conventional product 1 and 2 were worn away in a round shape.

Example 2

In this Example, cutting segments shaped as in FIGS. 15 (*b*) to (*f*) were manufactured after varying a total number of diamond particle layers (rows on a cutting surface), number and thickness of thin blank sections, ratio of thin blank sections and diamond particle size, number and thickness of thick blank sections, ratio of thick blank sections and diamond particle size, thickness ratio of thick blank section and thin blank section, as shown in FIG. 2. Cutting rate and useful life of the cutting segments were observed and the results are shown in Table 3 below.

The shape of samples 1 and 2 of Table 2 is depicted in FIG. 15 (*b*), that of samples 3, 4 and 5 is depicted in FIG. 15 (*c*), that of samples 6 and 7 is depicted in FIG. 15 (*d*), and that of sample 9 is depicted in FIG. 15 (*f*).

Cutting rate and useful life of samples shown in Table 3 are comparative values when the conventional products having diamond particles randomly dispersed therein are assumed to have a value of 100. At this time, the conventional products had a cutting rate of 315 $cm^2$/min and a useful life of 18.9 $m^2$/mm.

This Example employed 82-inch large-sized saw blades for machining big granite raw stone as a board plank. The machine basically featured a horse power of 50, peripheral speed of 35 m/sec, and cutting depth of 7 mm, which were however varied depending on conditions of the cutting tool. The work piece was granite having an intensity of class 3.

The cutting segments each had a length of 30 mm, thickness of 8.5 mm, height of 13.2 mm, and used, as a metal powder (bond), a mixture of cobalt, steel, nickel and copper having the same composition.

The cutting segment had a diamond concentration of 0.9 Conc. The diamond particles used were MBS-960 Ti2 available from D.I. corp., with an average particle size of US 40/50 mesh, which is 400□.

The samples of Table 2 had diamond particles arranged in rows including the thin blank sections and thick blank sections according to the invention.

TABLE 2

| Sample No. | No. of rows | Thin blank section No. | Thin blank section Gap(TN) (mm) | Thin blank section R* | Thick blank section No. | Thick blank section Gap[TW] (mm) | Thick blank section R* | TR** [TW/TN] |
|---|---|---|---|---|---|---|---|---|
| 1 | 10 | 5 | 0.24 | 0.6 | 4 | 0.825 | 2.06 | 3.44 |
| 2 | | 5 | 0.28 | 0.7 | 4 | 0.775 | 1.94 | 2.77 |
| 3 | 12 | 6 | 0.12 | 0.3 | 5 | 0.596 | 1.49 | 4.97 |
| 4 | | 6 | 0.26 | 0.65 | 5 | 0.428 | 1.07 | 1.65 |
| 5 | | 6 | 0.28 | 0.68 | 5 | 0.404 | 1.01 | 1.44 |
| 6 | 14 | 7 | 0.15 | 0.38 | 6 | 0.31 | 0.77 | 2.01 |
| 7 | | 7 | 0.16 | 0.4 | 6 | 0.30 | 0.74 | 1.85 |
| 8 | | 9 | 0.12 | 0.3 | 4 | 0.455 | 1.14 | 3.79 |
| 9 | | 10 | 0.16 | 0.4 | 3 | 0.43 | 1.08 | 2.71 |

*R: Ratio with diamond particle size

**TR: Thickness ratio of blank sections (TW/TN)

TABLE 3

| Sample No. | 1 | 2 | 3 | 4 | 5 | 6 | 7 | 8 | 9 |
|---|---|---|---|---|---|---|---|---|---|
| Cutting rate (%) | 133.6 | 130.4 | 125.3 | 128.9 | 120.4 | 118.6 | 111.4 | 101.5 | 87.3 |
| Useful life (%) | 114.4 | 123.6 | 140.6 | 135.8 | 128.5 | 143.7 | 144.5 | 147.3 | 150.1 |

As shown in Table 3, samples 1 to 9 according to the invention exhibit superior cutting rate and useful life to conventional products.

In comparison of samples 1 and 2, sample 1 has thick blank sections bigger than those of sample 2, thus improving cutting rate but shortening useful life.

Also, samples 3, 4 and 5 have more abrasive particle layers than samples 1 and 2, thus exhibiting lower cutting rate but longer useful life. In comparison of samples 4 and 5, a thickness ratio between blank sections of sample 5 is smaller than that between blank sections of sample 4. Accordingly, sample 5 shows inferior cutting and useful life to sample 4.

Samples 6, 7 and 8 have 14 abrasive particle layers, thus demonstrating less increase in cutting rate but considerable improvement in useful life.

In comparison of samples 6 and 7, sample 7 has blank sections with narrow thickness, thus prolonging useful life over sample 6 but reducing cutting rate.

Samples 8 and 9 have 14 diamond layers arranged therein. Sample 8 has 3 thin blank sections successively disposed in a lateral portion of the cutting segment, while sample 9 has 4 thin blank sections successively disposed in a lateral portion.

Samples 8 and 9 exhibit superior useful life to the Conventional products, but Sample 9 experiences a sudden decline in cutting rate since increase in the number of the thin blank section in the lateral portion leads to reduction in cutting rate.

As described above, according to the invention, preferably, the blank sections each have a thickness of 0.75 to 2 times the average diameter of the diamond particles. Preferably, a thickness ratio between the thick blank sections and thin blank sections is 1.5 times or more. Furthermore, preferably, four thin blank sections or more are not successively disposed.

Example 3

24-inch saw blades (samples 10 and 11) were prepared by welding cutting segments to an outer peripheral surface of a metal core, in which the cutting segments had thick blank sections and thin blank sections or had thick blank sections and non-blank sections.

Sample 10 was a cutting tool only comprised of one type of cutting segments each having the thick blank sections and thin blank sections disposed therein, out of the cutting segment types according to the invention.

Sample 11 was a cutting tool having both types of cutting segments alternately welded, out of the cutting segment segments according to the invention. Herein, all the cutting segments included the thick blank sections and non-blank sections, but in the cutting segments, the non-blank sections of a trailing cutting segment were disposed in the thick blank sections of a leading cutting segment.

FIG. 16 (*a*) illustrates a cross-section of cutting segments used in Sample 10. FIG. 16 (*b*) illustrates a cross-section of leading and trailing cutting segments used in Sample 11, in which numeral sign 700*a* denotes a cross-section of a leading cutting segment and 700*b* is a cross-section of a trailing cutting segment.

Tables 4 and 5 each indicate a total number of diamond layers (rows on a cutting surface), number and thickness of thin blank sections, ratio between thin blank sections and diamond particle size, number and thickness of thick blank sections, ratio between thick blank sections and diamond particle size, and thickness ratio between the thick blank sections and the thin blank sections regarding samples 10 and 11.

The cutting segments each had a length of 35 mm, thickness of 4.8 mm, height of 10 mm, and used, as a metal powder (bond), a mixture of cobalt, steel, nickel and copper having the same composition.

The cutting segment had a diamond concentration of 0.9 Conc. The diamond particles were MBS-970 Ti2 available from D.I. corp., with an average particle size of US 40/50 mesh, which is 400□.

The cutting tools (samples 10 and 11) had a horse power of 20 and peripheral speed of 45 m/s. A work piece was cut with a depth of 7 cm to examine cutting rate and useful life. The work piece was concrete having a compressive strength of 320 kgf/cm$^2$.

Table 6 indicates a comparative value of cutting rate and useful life of Samples 10 and 11 when a conventional cutting segment having diamond particles randomly dispersed therein is assumed to have a value of 100. At this time, the conventional product exhibited cutting rate of 700 cm$^2$/min and useful life of 5 m$^2$/mm.

TABLE 4

| Sample No. | No. of rows | Thin blank section No. | Thin blank section Gap(TN) (mm) | Thin blank section R* | Thick blank section No. | Thick blank section Gap[TW] (mm) | Thick blank section R* | TR* |
|---|---|---|---|---|---|---|---|---|
| 10 | 8 | 4 | 0.13 | 0.325 | 3 | 0.36 | 0.9 | 2.77 |

*R: Ration with diamond particle size

**TR: Thickness ratio of blank sections (TW/TN)

TABLE 5

| Sample No. | Segment types | No. of rows | Non-blank section No. | Non-blank section G*(mm) | Thick blank section No. | Thick blank section Gap [TW] (mm) | Thick blank section R* |
|---|---|---|---|---|---|---|---|
| 11 | Leading | 8 | 4 | 0.4 | 3 | 0.53 | 1.325 |
| | Trailing | 8 | 4 | 0.4 | 4 | 0.4 | 1 |

G*: Gap between rows (mm)

R**: Ratio with diamond particle size

TABLE 6

| Sample No. | 10 | 11 |
|---|---|---|
| Cutting rate (%) | 127.5% | 118.8% |
| Useful life (%) | 121.1% | 129.2% |

As seen in Table 6, samples 10 and 11 of the invention exhibit superior cutting rate and useful life to the Conventional products.

In comparison of samples 10 and 11, sample 10 experiences further improvement in cutting rate since the cutting segments thereof are deeply grooved and thus abrasive particles are protruded at a relatively bigger height.

Meanwhile, sample 11 exhibits longer useful life due to shallow grooves. The grooves are shallow because non-blank sections of a trailing cutting segment pass along a part of a work piece where thick blank sections of a leading segment pass.

While the present invention has been shown and described in connection with the preferred embodiments, it will be apparent to those skilled in the art that modifications and variations can be made without departing from the spirit and scope of the invention as defined by the appended claims.

INDUSTRIAL APPLICABILITY

As described above, the invention provides a cutting segment having excellent cutting rate and longer useful life, and a cutting tool.

The invention claimed is:

1. A cutting segment for a cutting tool comprising a plurality of abrasive particle layers disposed perpendicular to a cutting direction, each of the abrasive particle layers having a plurality of abrasive particle rows stacked in a width direction of the cutting segment, each of the abrasive particle rows having a plurality of abrasive particles arranged in a line, wherein the abrasive particle layers have a plurality of blank sections therebetween, in which abrasive particles are absent or have a concentration of 70% or less with respect to those in the abrasive rows, wherein the blank sections include relatively thick blank sections and relatively thin blank sections, wherein each of the thick blank sections has a thickness of 0.75 to 2 times the average diameter of the abrasive particles, and wherein a thickness ratio of the thin blank sections to the thick blank sections is 1.5 times or more.

2. The cutting segment according to claim 1, wherein the thin blank sections are disposed between the thick blank sections.

3. The cutting segment according to claim 2, wherein the thin blank sections and the thick blank sections alternate each other.

4. The cutting segment according to claim 2, wherein the number of the thin blank sections disposed between the thick blank sections is less than four.

5. The cutting segment according to any one of claims 1 to 4, at least two layers of the abrasive particle layers are equally concentrated.

6. The cutting segment according to claim 5, wherein the abrasive particle layers in a lateral portion of the cutting segment have a concentration greater than those in a central portion of the cutting segment.

7. The cutting segment according to any one of claims 1 to 4, wherein the abrasive particle layers in a lateral portion of the cutting segment have a concentration greater than those in a central portion of the cutting segment.

8. The cutting segment according to claim 7, wherein a relatively thinnest one of thick blank sections has a thickness ratio of 1.5 times or more with respect to a relatively thickest one of the thin blank sections.

9. The cutting segment according to claim 8, wherein at least two layers of the abrasive particle layers are equally concentrated.

10. A cutting segment for a cutting tool comprising at least two regions, each having a plurality of abrasive particle layers disposed perpendicular to a cutting direction in each of the regions, each of the abrasive particle layers having a plurality of abrasive particle rows stacked in a width direction of the cutting segment, each of the abrasive particle rows having a plurality of abrasive particles arranged in a line, wherein the abrasive particles are absent or have a concentration of 70% or less with respect to those in the abrasive rows, wherein the blank sections include relatively thick blank sections and relatively thin blank sections, and wherein at least some portions of the abrasive particle layers in leading and trailing ones of the regions are arranged so that a thin blank section of the trailing region passes along a thick blank section of the leading region during cutting of the work piece.

11. A cutting tool having a cutting segment as described in claim 1.

12. A cutting segment for a cutting tool comprising a plurality of abrasive particle layers disposed perpendicular to a cutting direction, each of the abrasive particle layers having a plurality of abrasive particle rows stacked in a width direction of the cutting segment, each of the abrasive particle rows having a plurality of abrasive particles arranged in a line, wherein the abrasive particle layers include therebetween a plurality of blank sections in which the abrasive particles are absent or have a concentration of 70% or less with respect to those in the abrasive particle rows, or a plurality of non-blank sections in which the abrasive particle layers contact or overlap each other, wherein the blank sections include thick blank sections, and wherein each of the thick blank sections has a thickness of 0.75 to 2 times the average diameter of the abrasive particles.

13. The cutting segment according to claim 12, wherein the non-blank sections are disposed between the blank sections.

14. The cutting segment according to claim 13, wherein the non-blank sections and the blank sections alternate with each other.

15. The cutting segment according to claim 13, wherein the number of the non-blank sections disposed between the blank sections is less than four.

16. The cutting segment according to any one of claims 12 to 15, wherein at least two layers of the abrasive particle layers are equally concentrated.

17. The cutting segment according to claim 12, wherein the abrasive particle layers in a lateral portion of the cutting segment has a concentration greater than those in a central portion of the cutting segment.

18. The cutting segment according to any one of claims 12 to 15, wherein the blank sections comprise at least two types having a different thickness.

19. A cutting segment for a cutting tool comprising at least two regions, each of the regions having a plurality of abrasive particle layers disposed perpendicular to a cutting direction in each of the regions, each of the abrasive particle layers having a plurality of abrasive particle rows stacked in a width direction of the cutting segment, each of the abrasive particle rows having a plurality of abrasive particles arranged in a line, wherein the abrasive particle layers include therebetween a plurality of blank sections in which the abrasive particles are absent or have a concentration of 70% or less with respect to those in the abrasive particle rows and a plurality of non-blank sections in which the abrasive particle layers contact or overlap each other, and wherein at least some portions of the abrasive particle layers in leading and trailing ones of the regions are arranged so that a non-blank section of the trailing cutting segment is disposed in a blank section of the leading cutting segment during cutting of a work piece.

20. A cutting tool having the cutting segment for the cutting tool as described in any one of claims 12 to 15.

21. A cutting tool comprising:

a plurality of cutting segments having abrasive particles dispersed therein; and a metal core having the cutting segments fixed thereto, wherein the cutting segments comprise a cutting segment as described in any one of claims 1 to 4, and wherein at least some portions of abrasive particle layers in leading and trailing ones of the cutting segments are arranged so that a thin blank section of the trailing cutting segment passes along a thick blank section of the leading cutting segment during cutting of the work piece.

22. A cutting tool comprising:

a plurality of cutting segments having abrasive particles dispersed therein; and a metal core having the cutting segments fixed thereto, wherein the cutting segments comprise a cutting segment as described in any one of claims 12 to 15, and wherein at least some portions of abrasive particle layers in leading and trailing ones of the cutting segments, a non-blank section of the trailing cutting segment is disposed in a blank section of the leading cutting segment during cutting of a work piece.

* * * * *